United States Patent [19]

Traczyk et al.

[11] Patent Number: 4,732,027

[45] Date of Patent: Mar. 22, 1988

[54] METHOD AND APPARATUS FOR NECKING AND FLANGING CONTAINERS

[75] Inventors: Edward S. Traczyk, Lockport; Michael M. Shulski, Northfield, both of Ill.

[73] Assignee: American National Can Company, Chicago, Ill.

[21] Appl. No.: 915,143

[22] Filed: Oct. 3, 1986

Related U.S. Application Data

[60] Continuation of Ser. No. 696,322, Jan. 30, 1985, abandoned, which is a division of Ser. No. 453,232, Dec. 27, 1982, Pat. No. 4,519,232.

[51] Int. Cl.[4] ..... B21D 31/00; B21D 41/00; B21D 51/26

[52] U.S. Cl. ..... 72/133; 72/391; 72/452; 413/69

[58] Field of Search ..... 72/94, 133, 356, 391, 72/399, 452; 74/568, 569; 413/69; 82/14 A, 19

[56] References Cited

U.S. PATENT DOCUMENTS

| | | | |
|---|---|---|---|
| 2,473,287 | 6/1949 | Maloney | 74/568 |
| 3,587,359 | 6/1971 | McCash et al. | 82/19 X |
| 3,812,696 | 5/1974 | Kneusel et al. | 413/69 |
| 3,928,519 | 12/1975 | Kashiyama et al. | 72/271 |
| 3,983,729 | 10/1976 | Traczyk et al. | 413/69 |
| 3,995,572 | 12/1976 | Saunders | 72/348 |
| 4,446,714 | 5/1984 | Cuacho | 413/69 |

*Primary Examiner*—E. Michael Combs
*Attorney, Agent, or Firm*—Robert A. Stenzel; Ralph R. Rath

[57] ABSTRACT

A modular system for producing triple-necked open ended containers includes three substantially identical necking modules each having the same frame and identical rotatable turrets which have a plurality of identical necking stations around the periphery. Each necking station includes an annular necking die and a platform and punch which are cam-operated to move towards and away from each other and are maintained in engagement with the cams by pressurized fluid. Each necking station also has a container pressurizing means in the form of an annular chamber which acts as a holding chamber prior to transmitting the pressurized fluid into the container.

9 Claims, 17 Drawing Figures

162
202
200
204
210
212
214
216
218
160
150
206
208

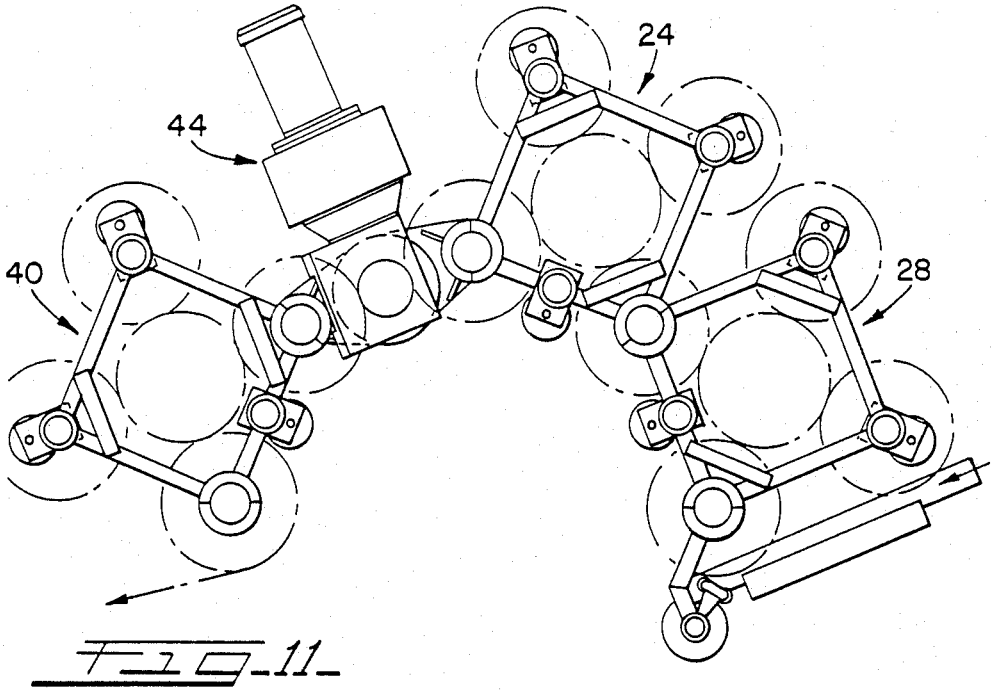
FIG. 11
FIG. 12
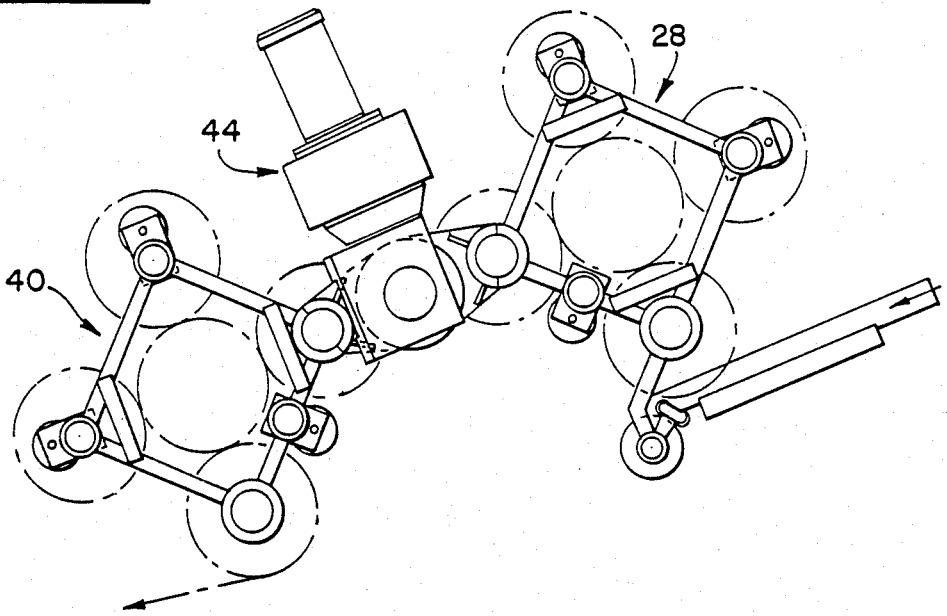

| FLEXIBILITY OF NECKING MODULES TO PRODUCE SINGLE, DOUBLE, AND TRIPLE NECKED CONTAINERS. | | | |
|---|---|---|---|
| CAM CHANGE REQUIRED TO PRODUCE CONTAINERS AT RIGHT. NO TOOLING CHANGE REQUIRED | | | CONTAINERS |
| 1ST. NECKING MODULE 211-209 DIE | 2ND. NECKING MODULE 209-207.5 DIE | 3RD. NECKING MODULE 207.5-206 DIE | |
| SINGLE NECK CAM<br>DOUBLE NECK CAM<br>TRIPLE NECK CAM | DWELL CAM<br>DOUBLE NECK CAM<br>TRIPLE NECK CAM | DWELL CAM<br>DWELL CAM<br>TRIPLE NECK CAM | SINGLE NECK CONTAINER 211-209<br>DOUBLE NECK CONTAINER 211-209-207.5<br>TRIPLE NECK CONTAINER 211-209-207.5-206 |
| DWELL CAM<br>DWELL CAM | SINGLE NECK CAM<br>DOUBLE NECK CAM | DWELL CAM<br>DOUBLE NECK CAM | SINGLE NECK CONTAINER 209-207.5<br>DOUBLE NECK CONTAINER 209-207.5-206 |
| DWELL CAM | DWELL CAM | SINGLE NECK CAM | SINGLE NECK CONTAINER 207.5-206 |

FIG. 16

FIG. 17

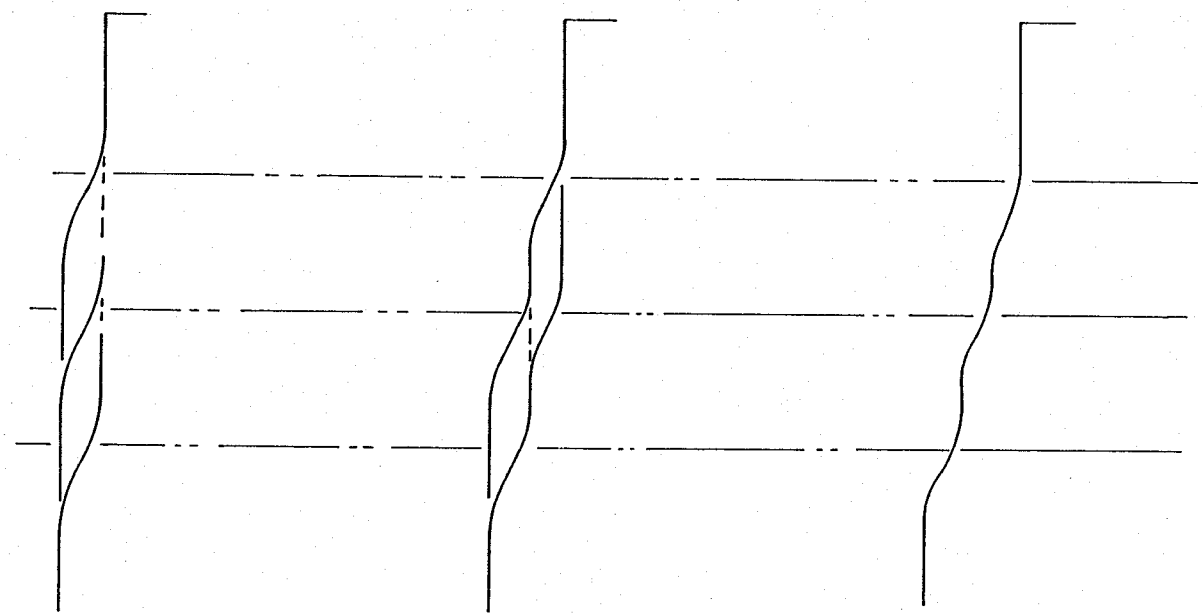

METHOD AND APPARATUS FOR NECKING AND FLANGING CONTAINERS

REFERENCE TO RELATED APPLICATION

This application is a continuation of Ser. No. 696,322, filed Jan. 30, 1985, abandoned, which is a divisional application of U.S. Ser. No. 453,232, filed Dec. 27, 1982, now U.S. Pat. No. 4,519,232.

DESCRIPTION

1. Technical Field

The present invention relates generally to the method and apparatus for producing containers having reduced end portions adjacent an open end of the container and outwardly-directed flanges thereabove and, more particularly, is directed towards a modular system readily adaptable to vary the reduced portion.

2. Background Prior Art

The most common type of metal container used in the beer and beverage industry is what is commonly referred to as a two-piece can. The two-piece can consists of a first piece comprising a cylindrical can body portion having one end closed with an integral end wall and where, after the filling process, a separately-formed end panel is attached to the upper end of the container by what is referred to as a double seaming process. With the cylindrical body portion, the double seaming process results in the seam extending beyond the peripheral surface of the container body. In such cases, it has been customary in recent years to produce a necked-in portion on the container body adjacent the open end so that the double seam between the container body and the end panel is located within the confines of the periphery of the cylindrical container body. This provides a more compact package for the containers, which in turn lowers the total shipping and storage costs.

Because of the increased demand for this necked-in type of container, considerable efforts have been devoted to produce an apparatus which is capable of reducing the neck and the peripheral edge on a container body in a rapid and reliable manner.

As the cost of materials has increased, it has been found desirable to reduce the amount of material to a minimum, yet preserve the integrity of the container. One area where manufacturers have explored the possibility of reducing the amount of metal used for producing a finished packaging container is a reduction in the wall thickness of the sidewall of the container. Continuous efforts have been directed towards reducing the thickness of the initial blank that is drawn and ironed in the finished container which also reduces the wall thickness of the cylindrical portion of the container during the drawing and ironing process. Whereas it has been possible to reduce the sidewall thickness in the can body to the order of 0.004 inches, the ends remain the normal thickness of 0.012 to 0.013 inches for beer and beverage containers.

This reduction in metal thickness of the body has resulted in inherent problems in producing a necked-in container utilizing the conventional annular necking die where the container is essentially forced into the annular die to reduce the open end of the container or necked-in portion of the open end of the container. This is particularly true where the containers are processed on high-speed equipment.

Various apparatus have been proposed for producing drawn and ironed containers having either a single neck-in portion, a double necked-in portion or possibly even a triple necked-in portion. Examples of such proposals are disclosed in U.S. Pat. Nos. 3,812,696; 3,687,098; 3,983,729; and, 4,070,888.

Because of the reduced wall thickness, additional problems have become inherent in reforming the container body during the necking process. Various proposals have been suggested and one of such proposals is to utilized pressurized fluid internally of the container to strengthen the column load force of the sidewall of the container during the necking process. There are particular problems inherent in processes as the speed of production is increased.

SUMMARY OF THE INVENTION

According to the present invention, a new modular system for producing necked-in containers includes a plurality of substantially identical modules and each module has a plurality of stations, each of which includes two relatively movable members that are moved towards and away from each other by cam means to produce a container that has either a single neck, a double neck or a triple neck of various diameters. It will be understood that one module may be added to provide a flange on any one of a single-, double- or tripled-necked container. Processing of the containers in a vertical orientation provides many advantages including, but not limited to assuring that the neck is perpendicular to the body, gravity transfer and ready accessible in the event a jam has to be cleared. Various functions are performed in different sections of each module.

One of the important aspects of the present invention is that the cam means that are utilized for moving the container into engagement with the necking die are segmented so that a single segment can be removed and replaced with another segment in a matter of minutes to allow a change in the necking operation to produce either a single-necked, a double-necked or a triple-necked container without any modification of any of the other components of the necking system.

Each container necking module preferably consists of a turret which is rotatable about a fixed axis and has a plurality of identical necking stations on the periphery thereof with each necking station having a stationary necking die, a punch reciprocable along an axis parallel to the fixed axis for the turret and a platform also movable along the axis with the punch and platform being movable by cams and cam followers. According to a further aspect of the present invention, the cams and cam followers are continuously maintained in direct engagement with each other through pressurizing means in the form of either pressurized pneumatic fluid, pressurized hydraulic fluid or a combination of the two. The pressurizing means for maintaining engagement between the cams and cam followers also produces a centering effect between the movable platform and necking die, thereby reducing the possiblity of misalignment between these two components.

According to a further aspect of the invention, the container necking apparatus also includes a means for applying pressurized fluid to the container before any substantial deforming of the metal takes place. The pressurizing means for the container preferably consists of a holding chamber that is positioned closely adjacent to the necking die and which is fully pressurized before the container enters the necking die. The pressurizing means also includes a valve which is defined between the necking die and knock-out punch so that the pressurized fluid is close to the container and fully pressurizes the container prior to the actual necking operation. The valve is preferably an annular valve that is an integral part of the tooling and allows for rapid pressurization of the can so that the speed of the machinery can be increased. The holding chamber is also preferably annular so that a large amount of fluid can be transferred into the container in a short period of time, thereby providing further increased production speeds.

DESCRIPTION OF SEVERAL VIEWS OF DRAWINGS

FIG. 1 of the drawings discloses a necking and flanging apparatus incorporating the modular nature of the present invention;

FIG. 11 is a necking and flanging apparatus for forming a double neck and flange on a container;

FIG. 12 is a necking and flanging apparatus for forming a single neck and flange on a container;

Figure 15:
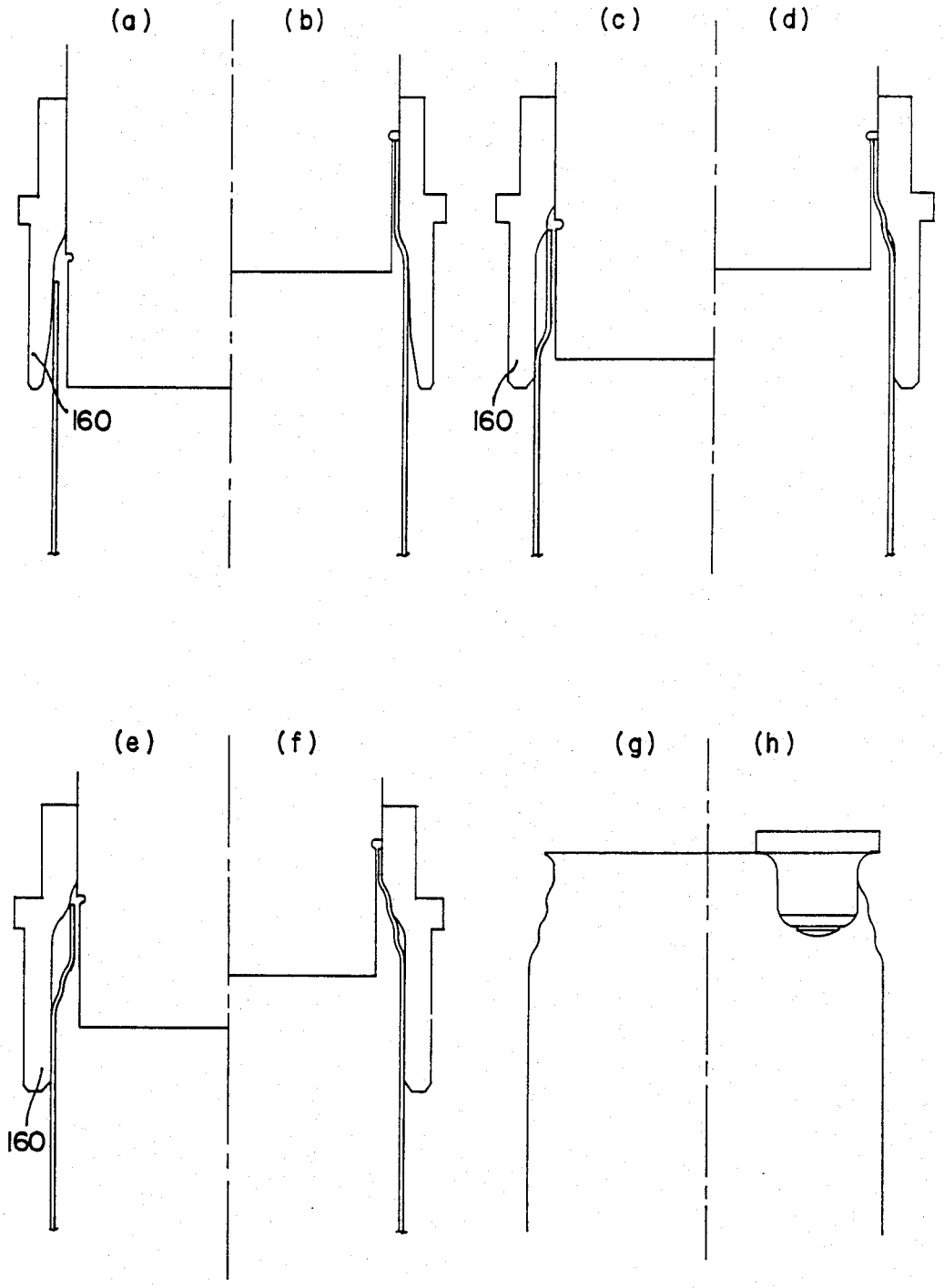

FIG. 15 a-h show the stages of the tooling in forming a triple necked and flanged container;

FIG. 16 is a chart showing the flexibility of the modular concept; and

FIG. 17 shows the three necking operations performed on the upper end of the container.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspects of the invention to embodiments illustrated.

Figure 1:
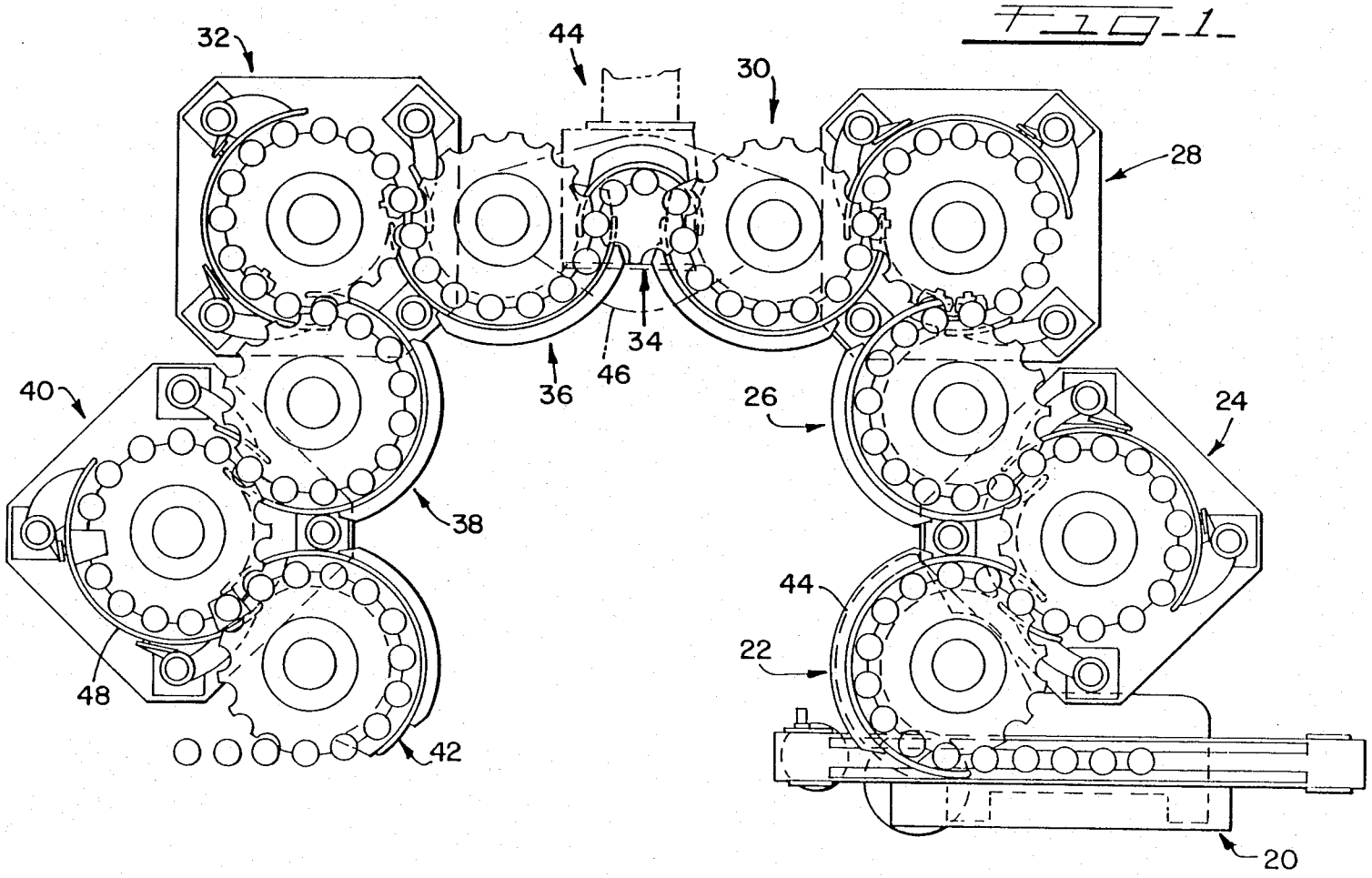
Figure 9:
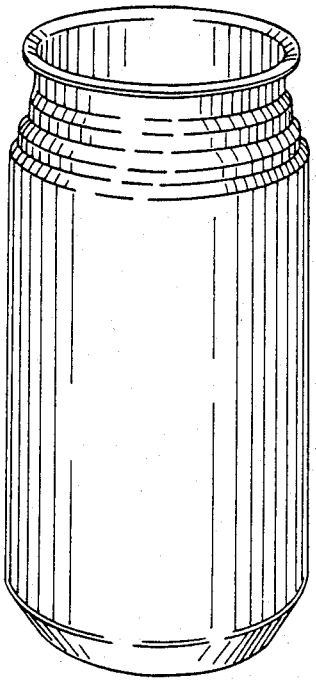
FIG. 9 is a perspective view of a finished triple necked and flanged container.
Figure 9:
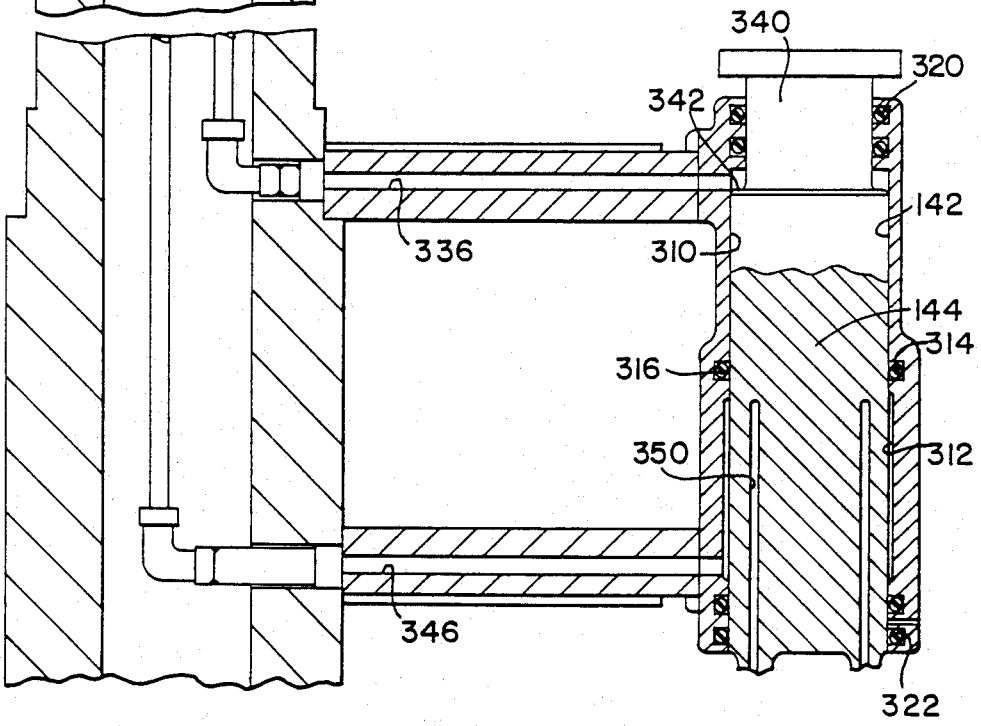

FIG. 1 of the drawings disclosed in plan view the overall necking and flanging apparatus designed to produce a container having a triple neck and an outwardly-directed flange which has now become popular since it reduces the amount of thicker metal needed for forming the end of the container. The finished triple-necked container is illustrated in FIG. 9.

The necking and flanging apparatus consist of a container-feeding apparatus, generally designated by reference numeral 20, which feeds the containers to a first transfer wheel, generally designated by reference numeral 22. The first transfer wheel 22 delivers containers to a first necking module, generally designated by reference numeral 24, where a first neck is produced on the container, as will be described later. The containers with the first neck are then delivered to a second transfer wheel 26 which delivers the containers to a second necking module 28 where a second neck is produced on the container and is then delivered to a third transfer wheel 30. The containers are then moved to a third necking station 32 by a pair of transfer wheels 34 and 36. A third neck is produced in the third necking module 32 and the containers are then moved by a further transfer wheel 38 to a flanging module 40 where the outwardly-directed flange is produced on the container and is delivered to transfer wheel 42 for delivery to an exit conveyor (not shown).

According to one aspect of the invention, all of the moving members in the necking and flanging apparatus are driven by a single drive means 44 which includes a variable speed motor connected to an output transmission 46. The output transmission has an output shaft (not shown) which has a gear affixed thereto. Each of the transfer wheels, as well as the necking modules and flanging module, have gears in mesh with each other to produce a synchronized continuous drive mechanism between the centrally located drive means and all of the components on opposite sides thereof.

The variable speed drive allows automatic increase and decrease of speed of the module to match the quantity of containers flowing through the module to the flow in the remainder of the container line. The variable-speed drive also allows the operator to accurately index the unit.

The necking and flanging apparatus also has suitable arcuate guide elements 48 and 49 associated with each of the stations, as well as each of the transfer wheels.

According to one aspect of the invention, each of the modules 24, 28, 32 and 40 are substantially identical in the frame structure so as to be interchangeable and can be added or subtracted depending upon the type of container that is to be formed. Furthermore, each of the necking modules has a plurality of circumferentially-spaced individual, identical necking stations, there being fifteen illustrated in FIG. 1 of the drawings, but the number can be increased or decreased. The details of each of the necking stations will be described in further detail later.

Each of the modules (FIG. 14) has an infeed segment, a forming segment, a stripping segment, a dwell/eject semgnet and a discharge segment, as will be described later.

The modular concept and the C-shaped configuration has a number of advantages. The frame structure for each module is identical so that the inventory of parts can be significantly reduced. Also, all of the transfer wheels are identical in construction to further reduce the inventory of parts. The C-shaped floor plan layout allows a single operator in the center to visually observe all modules without any movement.

Frame Structure

Figure 2:
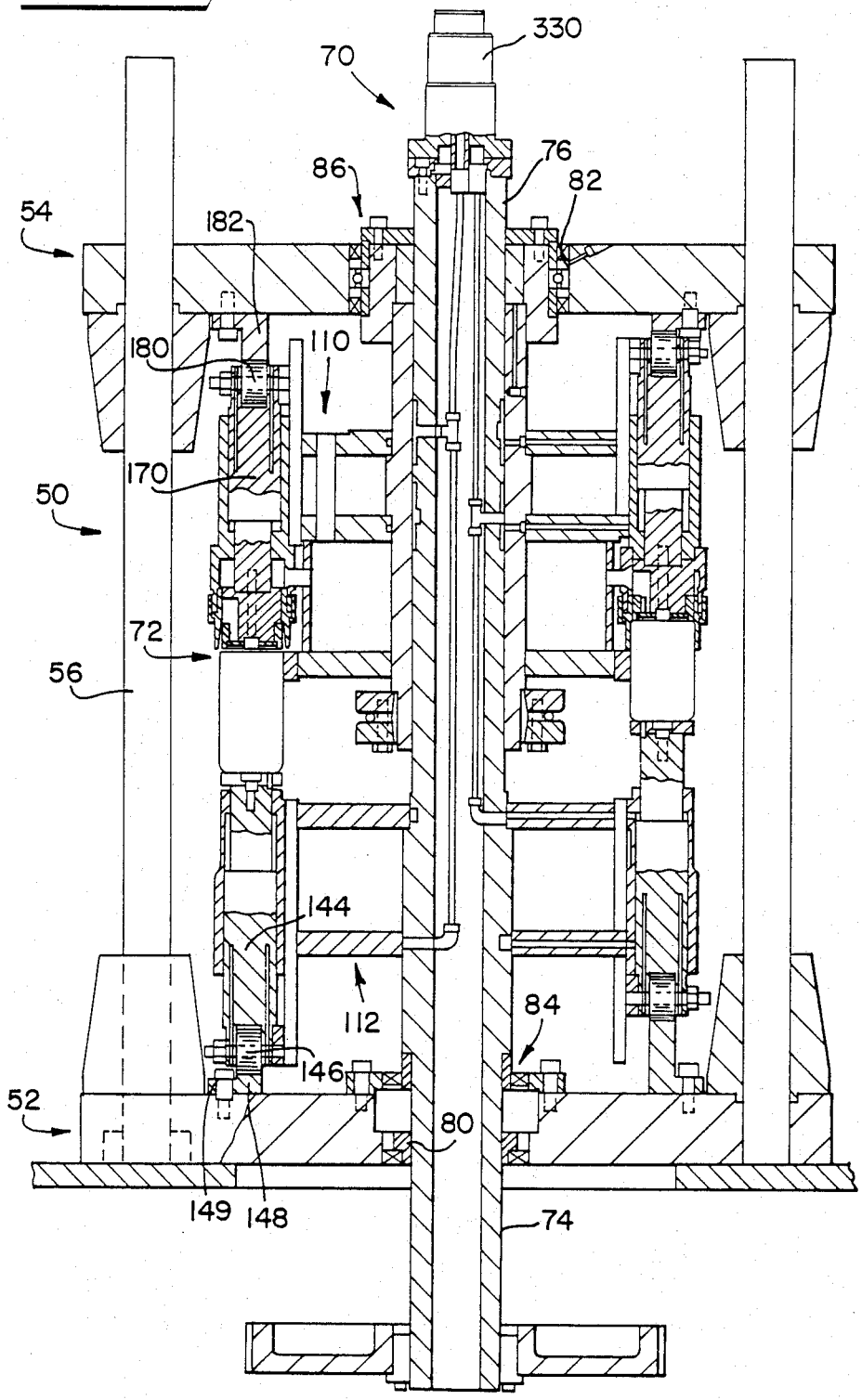
FIG. 2 is a cross-sectional view of two necking stations of one module illustrated in FIG. 1.

As described above, each of the modular units is identical in construction and includes a framework generally designated by reference numeral 50 in FIG. 2. This framework 50 consists of a lower frame member 52 shown in plan view in FIG. 1 and an upper frame 54 interconnected by columns 56. The frame work 50 may be suitably supported in the line as required. Columns 56 are suitably connected to frame members 52, 54 so that a solid structure is provided to assure the accuracy of alignment of the various movable components, which will be described later.

During manufacture, each pair of lower and upper frame member 52, 54 are machined and bored together as matched sets to insure absolutely accurate alignment between the frame member when they are assembled with the columns and a rotary turret assembly generally indicated at 70. This accuracy of the equipment is important to consistantly produce high quality uniform thin walled containers.

Rotary Turret Assembly

The frame structure 50 provides a support for the rotary turret assembly 70 that holds a plurality of identical necking stations 72 around the periphery thereof and in fixed relation to each other. The turret assembly as shown in FIG. 2 comprises a lower turret 74 and an upper turret 76. The lower turret 74 may take the form of a hollow central drive shaft that extends through openings 80 and 82 in frame members 52 and 54 and is rotatably supported by suitable bearing means, such as bearing means 84. The upper turret 76 is telescoped onto lower turret 74 and is held in adjusted positions by a wedge mechanism 86. When it is desired to change the mechanism, as for example to neck different height containers, the telescoping nature of the lower and upper turrets allows them to be accurately repositioned without changing the alignment of the necking stations. An upper hub means 110 provides support means for the upper portion of the necking station and extends radially from the upper turret 76. Likewise, lower hub means 112 extend radially outwardly from lower turret 74 and support the lower portion of the necking stations 72. The hub means have aligned portions on the outer periphery thereof which are machined as matching pairs to insure accuracy in alignment between the upper and lower portions of the necking stations 72.

Necking Stations

Figure 3:
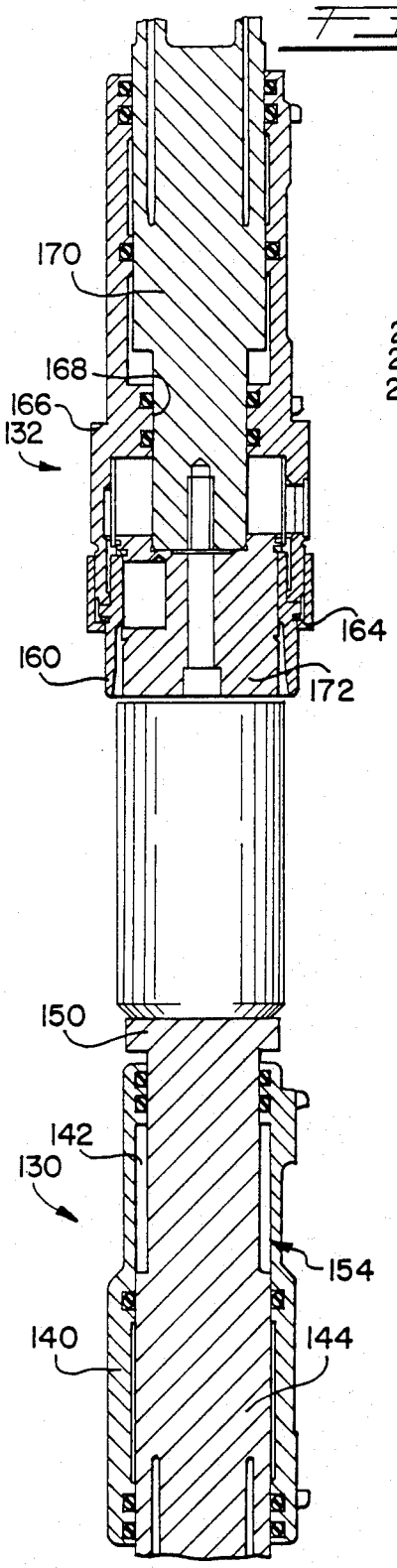
FIG. 3 is a cross-sectional view of one of the necking stations.
Figure 4:
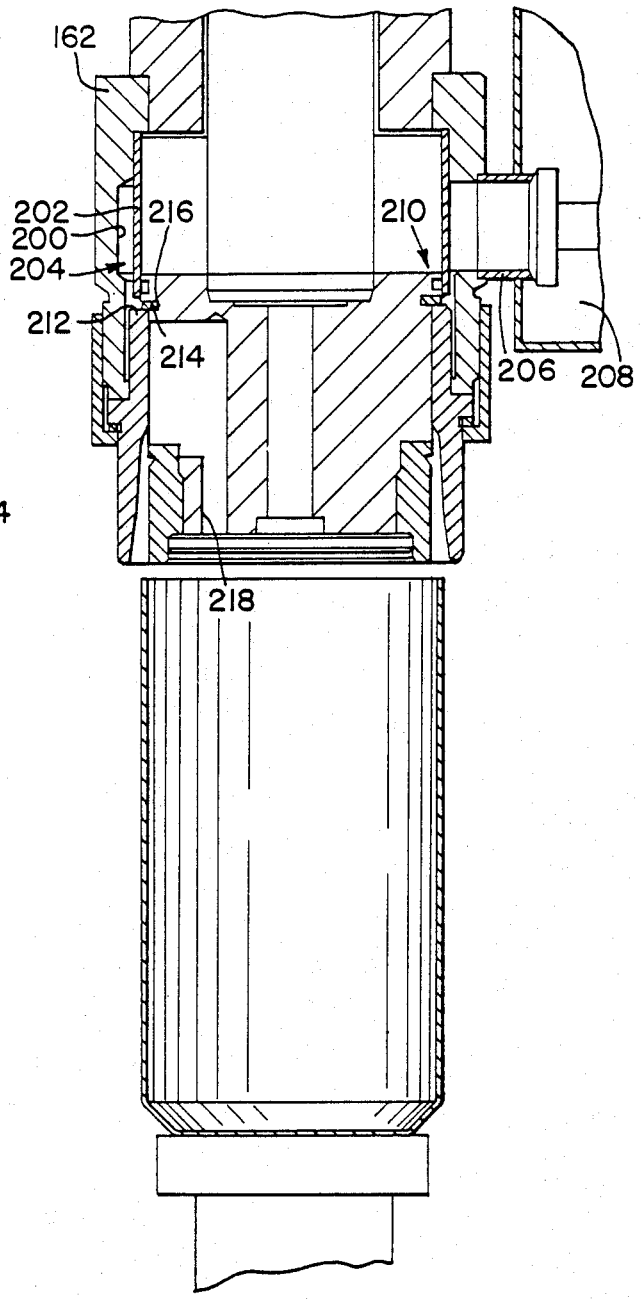
FIG. 4 is an enlarged fragmentary cross-sectional vies of the necking die assembly.

A necking station is illustrated in more detail in FIGS. 3 and 4 where it may be seen to include a lower container lifting portion generally indicated at 130 and an upper forming or necking portion generally indicated at 132. The lower lifting portion 130 includes an outer cylindrical member or sleeve 140 that has a generally circular opening 142 with a ram or piston 144 reciprocable in the opening 142. The lower end or ram 144 has a cam follower 146 (shown in FIG. 2) which images with a cam 148 supported on lower frame member 52. The upper end of ram 144 provides a container platform 150 and cooperates with sleeve 140 to provide a fluid centering mechanism, generally designated by reference numeral 154.

The upper necking portion 132, as shown in FIGS. 3 and 4, includes a single neck tooling having a fixed necking die element 160 that is secured to a hollow cartridge 166 by means of a threaded cap 164. The cartridge 166 has an opening 168 in which a plunger 170 is reciprocally mounted. The lower end of plunger 170 has a knock-out punch or internal forming member 172 supported thereon.

Figure 13:
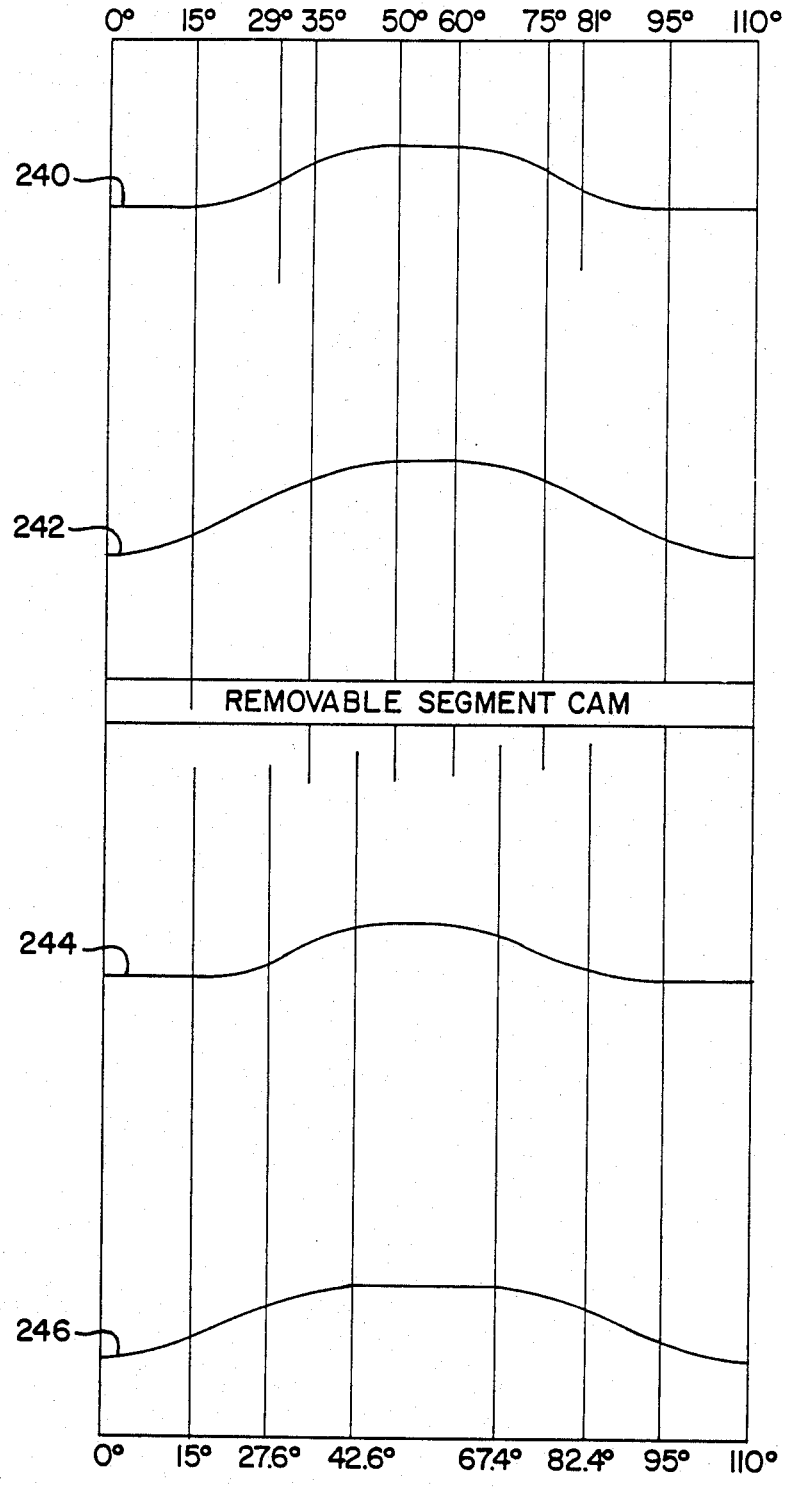
FIG. 13 is a diagramic view showing a plot of the movement of the container support member and the internal forming tool.

As illustrated in FIG. 2, the upper end of plunger 170 has a cam follower 180 rotatably supported thereon which is in continuous engagement with an upper cam 182, a plot of which is shown at 240 in FIG. 13.

Container Pressurizing Mechanism

According to one aspect of the present invention, the necking apparatus of the present invention incorporates a unique container pressurizing means for automatically fully pressurizing the container before any substantial metal deforming takes place in the necking operation. As illustrated in FIG. 4, annular sleeve 162 has an enlarged groove 200 and a sleeve 202 associated therewith which cooperate to define an annular chamber 204. The annular chamber 204 is in communication through a conduit 206 with a supply chamber 208 that is formed on the hub means 110 of the turret assembly 70.

The upper annular edge of necking die 160 and the upper peripheral edge of knock-out punch 172 cooperate to define an annular valve means 210. This annular valve means is illustrated in FIG. 4 and includes an upper horizontal edge 212 of necking die 160 cooperating with a resilient gasket 214 received into an annular groove 216 on the upper edge of the knock-out punch 172. Knock-out punch 172 has one or more passages 218 that place the interior of the necking die in communication with the open end of the container when the valve means 210 is opened. Thus, when elements 212 and 214 are in the position illustrated in FIG. 4, the valve means 210 is closed and seals chamber 204, preventing fluid flow to passages 218.

Figures 5, 6, 7, 8:
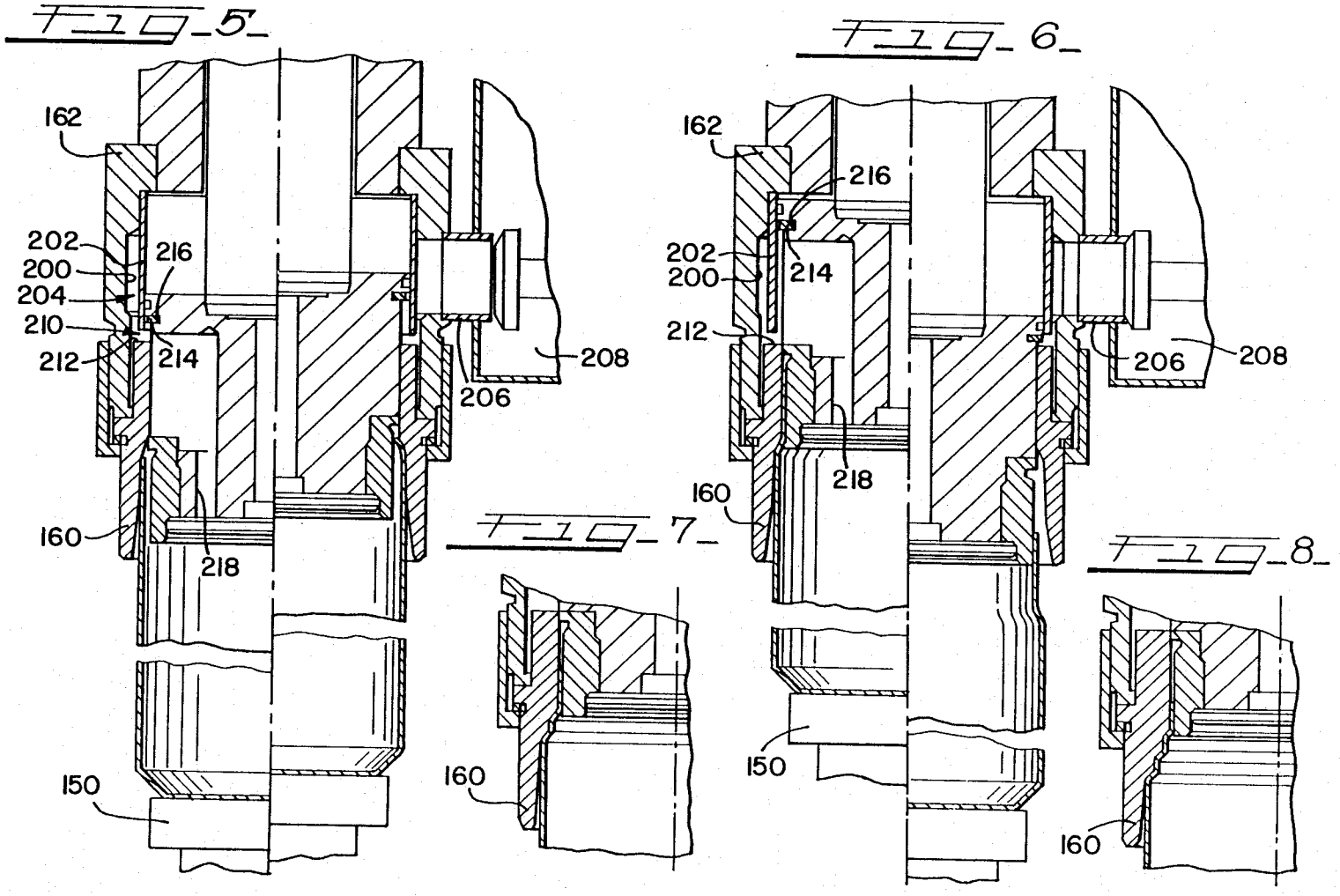
FIG. 5 is a view similar to FIG. 4 showing the steps as the container is moved into the necking die.
FIG. 6 is a view similar to FIG. 5 showing the finished necked containers.
FIG. 7 is a cross-sectional fragmentary view of the container after the second necking operation.
FIG. 8 is a view similar to FIG. 7 showing the container after the third necking operation.

The sequence of operation of the container pressurizing means can best be understood in reference to FIGS. 4, 5 and 6. In the initial position illustrated in FIG. 4, the container C is in the lowermost position with respect to necking die 160 and is spaced therefrom, while valve means 210 is closed, and the annular chamber 204 is pressurized with a predetermined amount of pneumatic air at a predetermined pressure sufficient to establish a predetermined pressure within the container once the pressurized air or pneumatic fluid is transmitted from the annular chamber 204 to the interior of the container C. The platform 150 is then raised by a suitable configuration of the cam 148, as shown in FIG. 2 and plotted at 242 in FIG. 13, and moved upwardly a sufficient distance to engage the tapered lower end portion of the necking die 160 and move toward the position illustrated on the left-hand side of FIG. 5. After the upper edge of the container moves past the tapered portion of the necking die 160, the knock-out punch is caused to be moved upwardly a slight distance to open the valve means 210 in the position illustrated on the left-hand side of FIG. 5. All of this occurs prior to a significant deformation of the metal around the upper open end of container C. During this time, a pneumatic seal is formed around the inner surface of the necking die 160 and the outer surface of the container C. The annular nautre of the holding chamber 204 for the pressurized pneumatic fluid insures that all of the fluid is rapidly dumped into the container to fully pressurize the container before any substantial metal deforming takes place in the first operation.

In practice, the pressure should be sufficient to provide proper column strength for the thin sidewall of the container. With current wall thicknesses, it has been determined that a pressure of about 10–18 psi is adequate for the rapid necking operation.

Once the container and knock-out punch are in the position illustrated in the left-hand portion of FIG. 5, the knock-out punch and container are both moved upwardly to generally the position illustrated on the right-hand portion of FIG. 5 where the necking operation commences. At this time, the container is fully pressurized so that the thin wall of the container is capable of resisting the large axial loads that are placed on it during the actual necking operation. More specifically, the container is at its maximum pressure before any substantial column load is developed in the sidewall.

The container and the punch are then moved generally as a unit from the position illustrated in the right-hand portion of FIG. 5 to the position on the left-hand portion of FIG. 6 where the finished necked container in its first stage is shown as having been completed. The container and knock-out punch are then moved in the opposite direction from the position illustrated in the left-hand portion of FIG. 6 to the position illustrated in the right-hand portion to remove the container from the necking die. Thus, the container remains in a pressurized state throughout this stage of the operation until the container is actually removed from the knock-out punch by suitable means, such as pressurized air. The relative movement between the punch and the container will be considered in further detail later during the discussion of the camming arrangement between the platform and the knock-out punch.

After the first necking operation is completed, the container is moved by transfer wheel 26 (FIG. 1) to the next module where the second necking operation is performed resulting in a double-necked container illustrated in FIG. 7. The double-necked container is then moved by transfer wheels 30, 34 and 36, which are part of the drive module, to the third necking module 32 where the third neck is produced, as illustrated in FIG. 8. The sequence of container wall deformation and flanging is shown in FIG. 15.

The triple-necked container is then moved by transfer wheel 38 to flanging module 40 where an outwardly-directed flange is produced resulting in the finished container illustrated in FIG. 9.

Cam Construction and Configuration

As described above, the configuration and construction of the cams 148 and 182 are important for the proper functioning of the unit which is to prevent distortion of the containers during the necking operation. As will be appreciated, both cams 148 amd 182 extend the entire circumference of the circular path of the respective necking stations 72 and have exposed surfaces configured to produce a desired movement of the container and/or knock-out punch during each cycle or revolution.

According to one aspect of the present invention, the cams 148 and 182 are configuration such that the movement of the container and the punch result in the metal around the upper open end of a container C being drawn into the die and/or stretched around the knock-out punch during the necking operation. This operation reduces forming loads imposed on the thin wall of the container to prevent sidewall collapse during forming. FIG. 13 shows the graph plotting movement of the knock-out punch by the line generally indicated by reference numeral 240 in FIG. 13 for the first necking operation.

An inspection of the diagram shown in FIG. 13 also discloses that all of the necking operation takes place in a span of about 100° of arcuate movement of the turret along its circular path. As can be seen from an inspection of FIG. 13, illustrating at 242 the container begins to be moved upwardly immediately at the 0° point on the graph along a gradual curve which has a substantially constant slope up to a point of about 50° of rotation of the turret. On the other hand, an inspection of the plot 240 of the movement of the internal forming tool 172 shows that during approximately the first 15° of rotary movement, the punch does not have any vertical movement thereby maintaining valve means 210 in a closed position until such time as the upper edge of the container is in a position where it is just beyond the tapered portion of the necking die 160, as may be seen on the left-hand side of FIG. 5, to produce a pneumatic seal between the other surface of the container and the inner surface of the necking die.

At approximately the 15° point, the knock-out punch 172 is caused to move upwardly slightly at a rate substantially less than the rate of movement of the container at that point to open the valve means 210 and pressurize the container completely before further deforming occurs. At a point of rotation of approximately 29°, it will be noted that the rise of the punch becomes equal to and slightly greater than the rise of movement of the container so that the punch is moving upwardly at a slightly greater rate than the container. In other words, the velocity ($V_1$) of the knock-out punch is greater that the velocity ($V_2$) of the container wall. The difference in the velocities allows for a reduction in the pressure requirements because the metal in the sidewall is being stretched and the sidewall of the container is being pulled upwardly. This insures that the portion of the container that is being deformed at this time is actually being drawn in to the tooling by the relative upward movement of the knock-out punch with respect to the upper end of the container rather than just being formed inwardly during the necking operation. This reduces the possibility of sidewall collapse or other imperfections. This constitutes the necking station.

After the necking operation is completed, the knock-out punch moves toward the container, while the container is in dwell period, to a position close to but not touching the container. Thereafter, both the container and punch move at identical rates, which are maintained until the container is stripped from the die. It is at this time that the pressurized air in the container pushes the containers from the knock-out punch and against the platform until the container is free of the knock-out punch.

According to one important aspect of the present invention, as shown in FIG. 13, at least the lower cam 148, in FIG. 2, which encompasses 360° of a circular pattern for the respective necking stations 72, has a small segment which is readily removable and quickly placeable to produce different configurations of necking operations in a given necking apparatus. By way of example and not of limitations, referring particularly to FIG. 13, the 360° cam 148 has a segment which encompasses approximately 110° of turret rotation which is held in position by a single fastening means 149 (FIG. 2) so that the cam segment can easily be removed and replaced. Thus, if, as explained more fully hereinafter, a different necking contour is desired on the upper end of the container, it is only necessary for the mechanic to remove fastening means 149 and replace the cam segment with a cam segment having a desired configuration that may produce a dwell in the segment rather that a necking operation. Also, having the segment removable and held with only a few screws will allow the mechanic to improve and replace the cam in a matter of minutes, thereby minimizing the time required for a changeover from one cam configuration to another.

Figure 14:
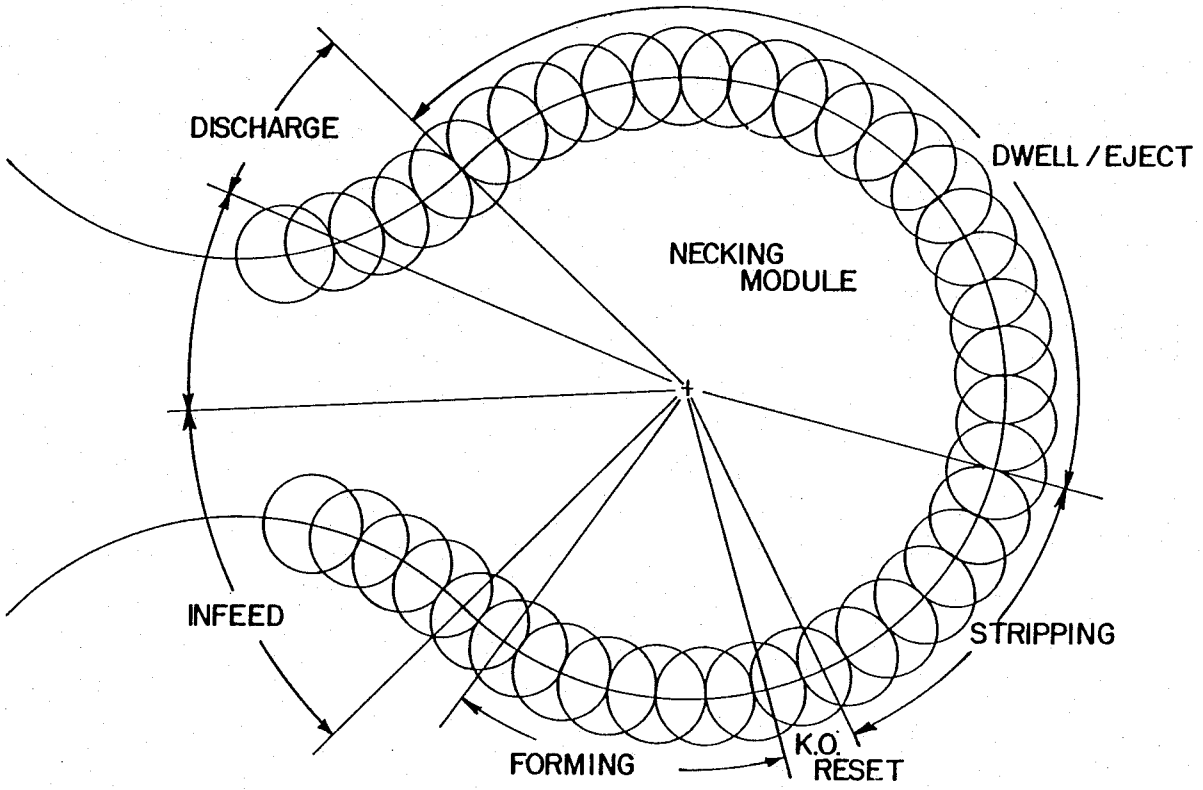
FIG. 14 is a diagramic view of the functions performed during movement around the functional area of a necking turret.

It should be noted from an inspection of FIG. 14 that in about one-third of the cycle of revolution all of the necking takes place, another one-third is a dwell segment where pressurization of the chamber takes place, and about one-third of the cycle is where loading and unloading takes place.

FIG. 13 shows the cam configuration for all modules dependent upon the neck profile required. Thus, a cam 242 is used in all three modules when a triple necking configuration is desired, a cam 244 is used two of the three modules along with a dwell cam in the third when double necking is effected and a cam 246 is used in one of the three modules along with dwell cam in the remaining two modules when only a single neck is mode.

There is illustrated in FIG. 16 by way of example a chart showing the cams required in each module for each combination of container necking that may be desired. Thus, once a container neck configuration is selected the cams necessary to effect such design are listed. In FIG. 17 it may seem that one can multiple neck containers with varying body diameters without changing any tooling in the modules. For example it may be understood be reviewing the top line of the chart that to include a single neck on a 211 diameter cam (2 11/16") the 211-209 single neck cam would be installed in the first module while the second and third modules are filled with dwell cams. On the other hand, if it is desired to produce a single neck on a 207.5 diameter cam (2 15/32") the first and second modules are equipped with dwell cams whereas the third module receives a single neck cam. The single neck cam used in this instance in the third module is in fact the same as that used in the first module for single necking the 211 cam. Similarly each dwell, double and triple neck cam is interchangeable.

Actual changing of the cams may be effected in a matter of minutes to minimize the cam manufacturing line change-over time. This is further minimized by using quick release fastener 149.

Lubricating, Pressurizing and Centering Means

According to a further aspect of the present invention, the necking and flanging apparatus of the present invention incorporates novel and unique lubricating, pressurizing and centering mechanisms for simultaneously maintaining all of the components axially aligned with each other and also maintaining the cam followers in continuous and constant engagement with the associated cam without the need for any second sets of cam followers that heretofore were necessary for insuring proper movement of the cam followers with respect to the cams. The lubricating and self-centering means will be described in reference to FIG. 10 in connection with the lower or platform assembly that was described above.

Figure 10:
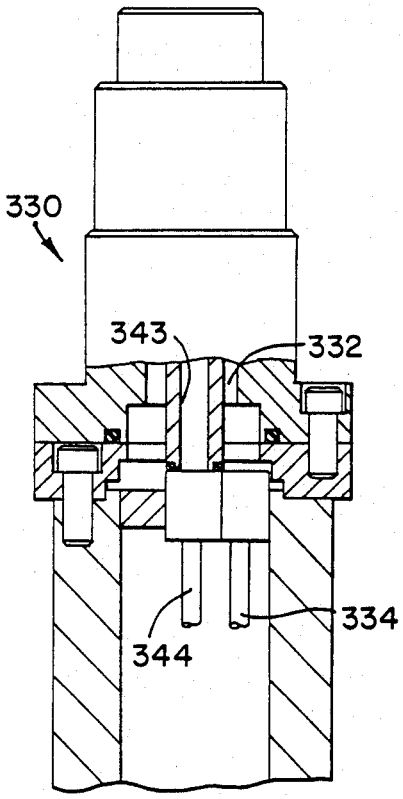
FIG. 10 is an enlarged fragmentary sectional view showing the centering mechanism for the container support member at one station.

With particular reference to FIG. 10, it will be noted that the circular opening 142 for the cyclindrical member or cylinder 144 has a reduced portion 310 at its upper end and a slightly enlarged portion 312 at its lower end with an annular recess 314 located at the lower end of the reduced portion 310. A gasket seal 316 is positioned in the annular recess to divide the reduced portion 310 into one chamber and the enlarged portion 312 into a second chamber. Suitable additional seals 320 and 322 are respectively located at the upper and lower ends of opening 142 and engage piston 144 so that the opening is divided into two chamber sections.

Pressurized air is delivered from a suitable source into a valve mechanism 330 at the upper end of turret 70 which aligns with shfat 74 and has a stationary part and a rotary part. Pressurized air is, thus, delivered through an annular chamber 332 to a plurality of conduits 334 (only one being shown) equal in number to the number of stations on turret 70. The lower end of conduit 334 is connected to an opening 336 extending through lower hub means 112 to be placed in communication with the reduced portion 310 of opening 142. Likewise, piston or plunger 144 has a slightly reduced portion 340 to define a shoulder 342 that is positioned in the upper chamber 310.

Rotary valve 330 also controls the flow of hydraulic fluid through an axial opening 343 aligned with the center of the hollow shaft 74 which is in communication with a conduit 344 which, in turn, supplies hydraulic fluid to an opening 346 located in lower hub means 112 of the turret. The opening 346 is in communication with small annular chamber defined between the outer peripheral surface of the plunger or piston 144 and the enlarged opening 312.

With the arrangement so far described, it will be apparent that continuous supply of pressurized pneumatic air through conduit 334 will continually force or produce a downwardly-directed force against the shoulder 342 to maintain continuous contact between cam followers 146 and cam 148 regardless of the position of the turret with respect to the cam. Likewise, continuous pressurized pneumatic fluid in conduit 334 opening 336 will produce a centering means for continually centering the piston or plunger 144 with respect to the outer cylinder 140. In this respect, the continuous pressurization of hydraulic fluid in conduit 344 and opening 346 will produce a continuous centering effect between the lower portion of piston 144 and cylinder 140. Also, the pnuematic fluid centering means also acts as an air-spring to absorb shock at the end of travel of the container downwardly. Stated another way, the pressurized hydraulic and pneumatic fluid produce a pressure jacket around the piston so that no mechanical alignment is relied upon.

The same lubrication that is utilized as the self-centering mechanism for the upper and lower pistons can likewise be utilized as an automatic lubrication means for the various components in the system. For example, an annular opening 350 can be provided in the plunger or piston 144 and placed in communication with the small annular chamber produced by the enlarged portion 312 of opening 142 to provide lubrication for the cam followers and the cam at a continuous flow rate.

Flanger Assembly

The flanger assembly 40 or unit can take a number of forms, but preferably is one of the type that has the same basic frame structure as to be interchangeable with any of the other frame structures in the assembly illustrated in FIG. 1. Since the flanger assembly forms no part of the invention, no detailed description of any particular flanger assembly appears to be necessary. However, for purposes of completeness, the flanger assembly manufactured and designation of Model 760 Necker-Necker-Flanger can readily be incorporated into the necker and flanger assembly of the present invention.

Alternate Basic System

The modular system allows for developing systems for producing containers having a single necked-in portion, a double necked-in portion or a triple necked-in portion.

FIGS. 11 and 12 of the drawings illustrate the versatility of the present system of modules of substantially identical construction with a single drive means as the power source for the entire system.

Comparing FIG. 11 with FIG. 1, it will be noted that the system outlined in plan view in FIG. 1 is designed for use with construction of containers having a triple-neck and a flange utilizing the single drive means 44. The entire system of modules can be rearranged to produce a single necking and flanging operations as illustrated in FIG. 12. By way of example and not of limitation, the system could intially be arranged to produce single-neck containers by using two modules, one being a necking module 28, and the second being a flanging module 40 with a drive unti 44 located between those modules. With such an operation, single-neck containers could readily be formed utilizing two modules constructed in accordance with the teachings of the present invention.

When economic conditions warrant additional capital expenditures, the single-necking system illustrated in FIG. 12 could then easily be converted into a double-necking system, illustrated in FIG. 11, by the purchase of an additional module 24, identical to original module 28 except for cam configuration so that double-necked containers could be formed with the same basic unit. At any time the customer requirements would require a single-necked container being formed for a short period of time, module 24, illustrated in FIG. 11, could be converted to a dwell module, thereby converting this unit from a double-necked container to a single-necked container. Likewise, the triple-necked cntainer apparatus illustrated in FIG. 1 could, at any time, be converted into a single-neck, a double-neck or a triple-neck container operation in a matter of minutes by merely replacing a single cam segment on the respective modules.

While the foregoing invention has been described in terms of single, double and triple necking, it will be understood that the inventive principal disclosed and claimed herein may be readily carried forward to form, five or more reductions or formations.

We claim:

1. A modular system for necking openended containers comprising a plurality of substantially identical modules, each including a turret rotated on a support and having a plurality of necking stations with each station having upper and lower necking elements moved relative to each other by cam followers and a stationary upper and lower cam associated with each module for moving said cam followers, said stationary cams being supported on said support and extending around the peripheral surface of said turret, said stationary cams having exposed face cam surfaces directed toward each other and towards respective cam followers for engagement therewith, at least said lower stationary cam having a removable cam-forming segment and releasable fastener means securing said cam-forming segment to said support so that a container necking configuration can be changed by replacement of said cam-forming segment without removal of said necking stations, and pressurized fluid means acting on said cam followers for maintaining continuous engagement between said cam followers and said exposed face cam surfaces during an entire cycle of revolution of said turret.

2. A modular system as defined in claim 1, further including a flanging module wherein each station of said module has flanging means for producing outwardly-directed flanges on the open ends of said open-ended containers.

3. A modular system as defined in claim 1, in which each of said modules includes a turret rotatable about a fixed axis and said stations are positioned around the periphery of said turrets and further including container transfer means between said turrets for transferring said containers between said turrets.

4. A modular system as defined in claims 1, 2 or 3, in which there are three functionally identical modules each with different tooling for producing three separate necking operations to produce containers having a triple neck.

5. A modular system as defined in claims 1, 2 or 3, in which there are two substantially identical modules having necking means at each station to produce a container having a double neck.

6. A modular system as defined in claim 1, 2 or 3, further including a single variable-speed drive means for all of said turrets and transfer means.

7. A modular system for sequentially necking open-ended containers comprising a plurality of substantially identical circular modules rotatable on support means, each module having a plurality of identical stations, each of said stations having a necking die, a punch and a container platform movable relative to each other by upper and lower cam followers movable by fixed cam means on said support means, the improvement of said cam means including upper and lower cam means mounted on said support means and extending around the periphery of said modules and each having a face cam defining an exposed cam surface aligned with and engaging said cam followers, pressurized fluid means for maintaining said cam followers in continuous engagement with said face cams during an entire cycle of revolution of said modules on said support means, at least said lower cam means having a forming segment, a dwell segment and a loading and unloading segment and wherein said forming segment of said cam means is separate from said dwell segment and said loading and unloading segment and wherein said forming segment cam is held by quick-release fasteners to be readily removable and replaced with a different cam configuration for a difference neck configuration without removal of any portion of said stations.

8. A modular system as defined in claim 7, in which each necking die is fixed to said turret and each station includes upper and lower fixed sleeves with said punch reciprocable in said upper sleeve and said container platform having an extension reciprocable in said lower sleeve.

9. A modular system as defined in claim 8, in which said means for maintaining said cam followers in engagement with said cam means includes pressurized fluid means in said sleeves.

* * * * *